US009632470B2

(12) United States Patent
Miyazaki

(10) Patent No.: US 9,632,470 B2
(45) **Date of Patent: *Apr. 25, 2017**

(54) IMAGE FORMING APPARATUS

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Yasunari Miyazaki, Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/186,785

(22) Filed: Jun. 20, 2016

(65) Prior Publication Data

US 2017/0090377 A1 Mar. 30, 2017

Related U.S. Application Data

(63) Continuation of application No. 14/865,331, filed on Sep. 25, 2015, now Pat. No. 9,395,669.

(51) Int. Cl.
*G03G 15/00* (2006.01)
*G03G 15/01* (2006.01)

(52) U.S. Cl.
CPC ..... *G03G 15/556* (2013.01); *G03G 15/0121* (2013.01); *G03G 15/5016* (2013.01)

(58) Field of Classification Search
CPC ..... G03G 9/0821; G03G 15/556; G03G 15/0856; G03G 15/0849; G03G 15/553; G03G 2215/0888
See application file for complete search history.

(56) References Cited

U.S. PATENT DOCUMENTS

| | | | | |
|---|---|---|---|---|
| 8,963,973 | B2 | 2/2015 | Imamiya | |
| 9,395,669 | B1 * | 7/2016 | Miyazaki | G03G 15/55 |
| 2006/0181726 | A1 | 8/2006 | Naito et al. | |

FOREIGN PATENT DOCUMENTS

| | | |
|---|---|---|
| JP | 2006-154485 | 6/2006 |

* cited by examiner

*Primary Examiner* — David Gray
*Assistant Examiner* — Michael Harrison
(74) *Attorney, Agent, or Firm* — Amin, Turocy & Watson LLP

(57) ABSTRACT

According to an example of an image forming apparatus, the apparatus includes an image forming unit configured to form a toner image by developing an electrostatic latent image formed on an image carrier using a toner and fixes the toner image on a recording medium, a count unit configured to count a use amount of a consumption component or an apparatus which are used in the image forming unit according to a image forming condition in the image forming unit, and a count changing unit configured to determine the toner used in the image forming unit and changes a count method of the count unit set according to the image forming condition in response to a determined result.

9 Claims, 7 Drawing Sheets

IMAGE FORMING APPARATUS

CROSS-REFERENCE TO RELATED APPLICATIONS

This application is a Continuation of application Ser. No. 14/865,331 filed on Sep. 15, 2015, the entire contents of which are incorporated herein by reference.

FIELD

Embodiments described herein relate generally to an image forming apparatus which performs developing using a plurality of toners.

BACKGROUND

Common units and individual units which are configuration components of an image forming apparatus are so called consumables, and need maintenance such as replacement (or supplement) regularly or as needed. A replacement time corresponding to a consumption degree is generally different in every component.

The image forming apparatus, which performs color printing, forms a color image using toners having a plurality of colors. The image forming apparatus forming the color image uses, for example, color toners of yellow (Y), magenta (M), cyan (C), and black (K). In terms of physical characteristics, each color toner is not much different from each other except a color difference. The colors of toners are changed but components thereof are barely changed, and therefore, an influence on a life span of a photoconductive drum or the other components is not largely changed due to the toner. Accordingly, in the related art, regardless of a consumption amount of each color toner, a replacement time of the photoconductive drum or the other components is set.

However, recently, a change of color is required, and a color different from a color of the related art, for example, a toner having gold color (here, this toner is referred to as a decorative toner) is used.

In such a decorative toner, a material different from a toner element of the related art, such as gold which is different from the color toner of the related art, is added. Therefore, a condition relating to the life span of each component is changed. While the component can be used long using the toner of the related art, the life span of the component may be reduced using such a decorative toner.

An exemplary embodiment is made under consideration of the above described circumstance. There is provided an image forming apparatus in which the replacement time of individual units such as the photoconductive drum can be objectively informed to a user even when the decorative toner such as a metallic toner is used, regardless of a presence or absence of an experience of an operator.

DETAILED DESCRIPTION

According to an embodiment, an image forming apparatus includes an image forming unit configured to form a toner image by developing an electrostatic latent image formed on an image carrier using a toner and fixes the toner image on a recording medium, a count unit configured to count a use amount of a consumption component or an apparatus which are used in the image forming unit according to a image forming condition in the image forming unit, and a count changing unit configured to determine the toner used in the image forming unit and changes a count method of the count unit set according to the image forming condition in response to a determined result.

Figure 1:
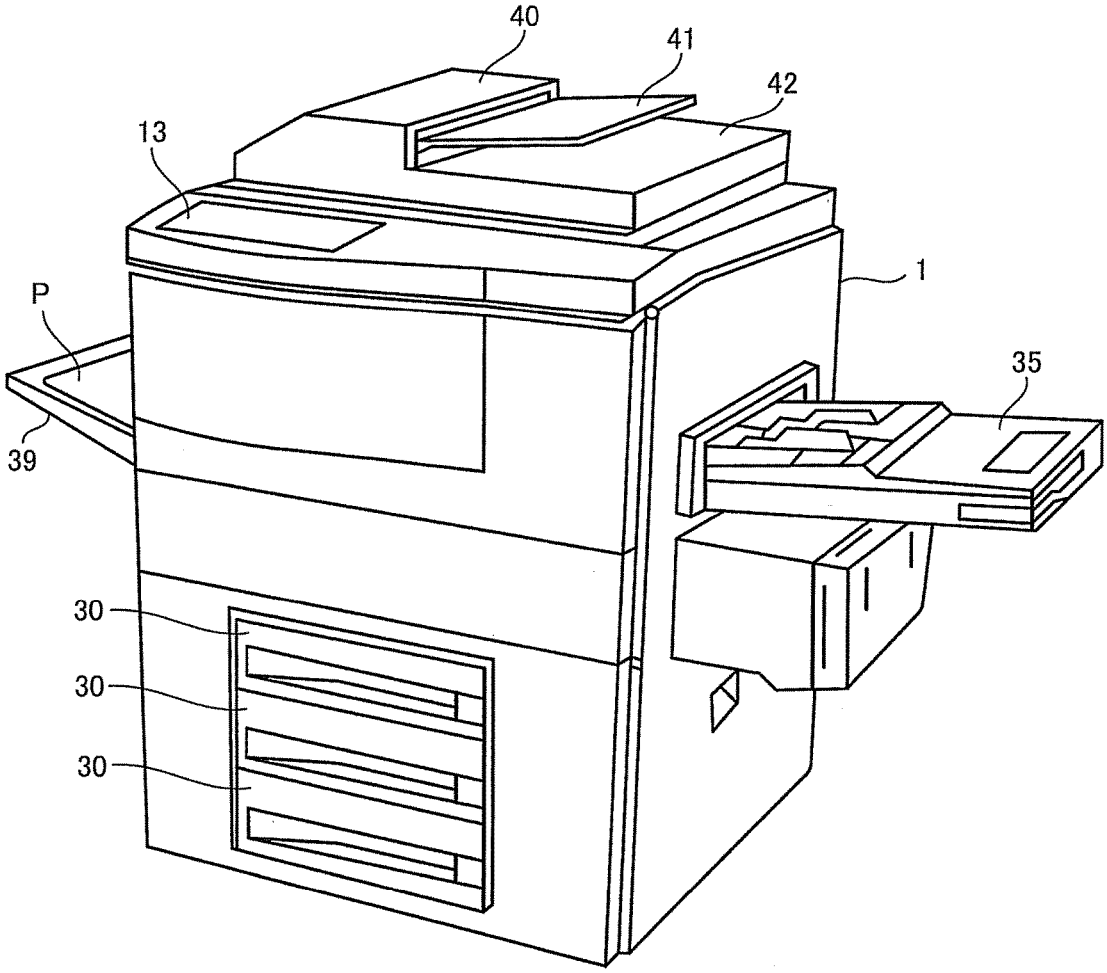
FIG. 1 is a perspective view illustrating an exterior of an image forming apparatus of an embodiment.
Figure 2:
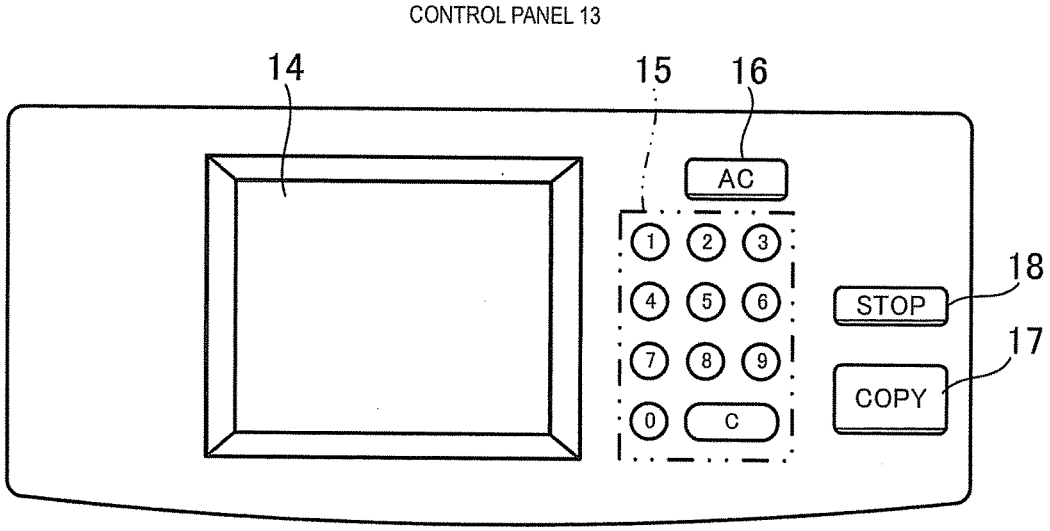
FIG. 2 is a view illustrating a control panel.
Figure 3:
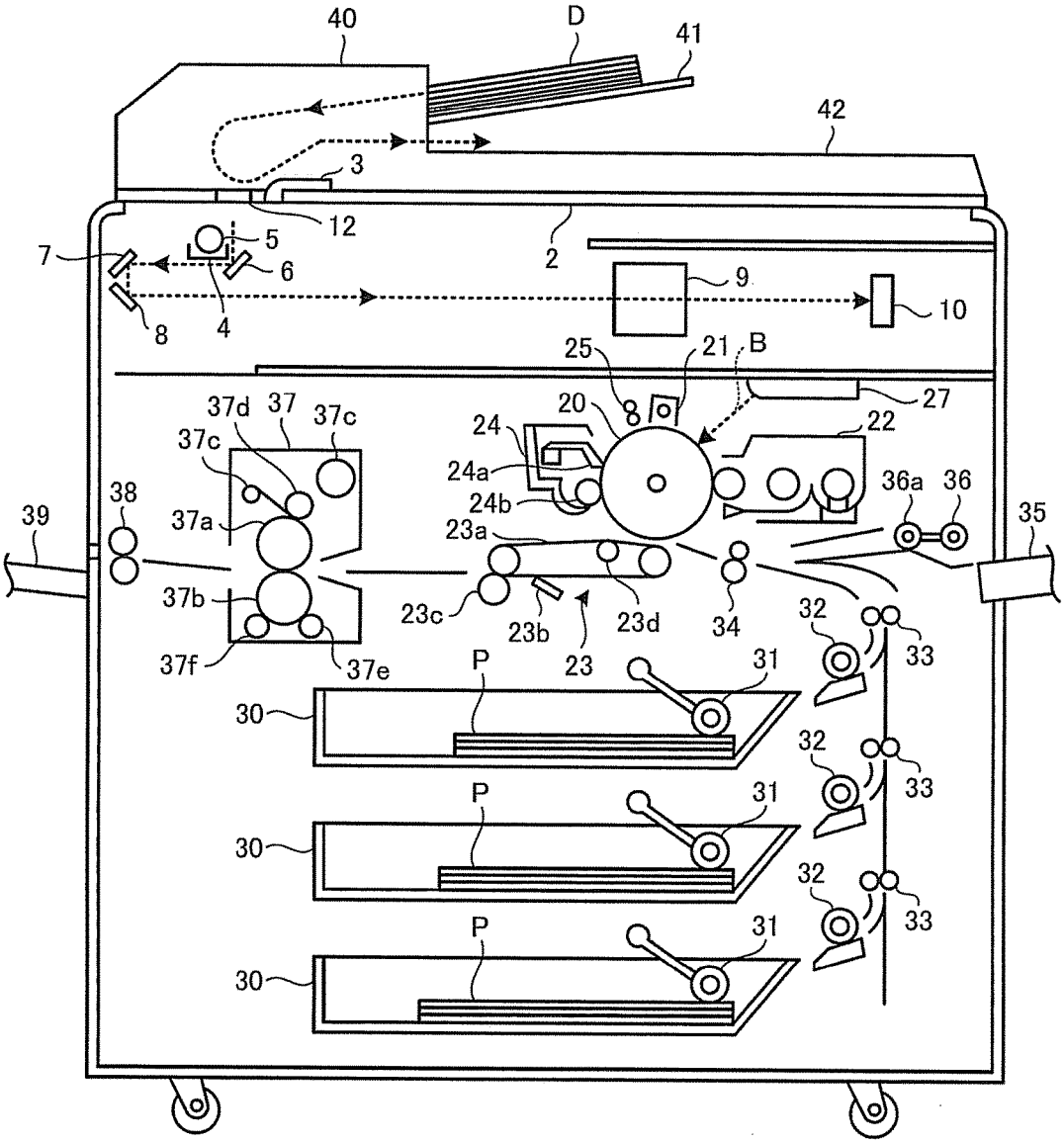
FIG. 3 is a view illustrating a schematic structure.

Hereinafter, an exemplary embodiment will be described with reference to drawings. FIG. 1 is a perspective view of an image forming apparatus of the embodiment. FIG. 2 is a front view of the control panel of the image forming apparatus of the embodiment. FIG. 3 is a schematic view of an inside configuration of the image forming apparatus of the embodiment.

As illustrated in FIG. 3, a transparent original document stand (glass board) 2 for placing an original document is provided on an upper surface portion of a main body 1. On a side portion of the original document stand 2, an indicator 3 is provided. A step portion between the indicator 3 and the original document stand 2 becomes a standard position for setting the original document.

A plurality of original document sensors 11 is disposed on a lower surface side of the original document stand 2. The original document sensor 11 optically detects a presence of the original document D which is set on the original document stand 2, and a size thereof.

A carriage 4 is provided on the lower surface side of the original document stand 2, and an exposure lamp 5 is provided on the carriage 4. An exposure unit is configured to have the carriage 4 and the exposure lamp 5. The carriage 4 can move (reciprocate) along the lower surface of the original document stand 2. While the carriage 4 reciprocates along the original document stand 2, and the exposure lamp 5 is turned on, the original document D placed in the original document stand 2 is exposed.

By such an exposure, a reflection light image of the original document D is obtained, and is projected to a charge coupled device (CCD) 10 by reflection mirrors 6, 7, and 8 and a magnification lens block 9. The CCD 10 includes a plurality of photoelectric conversion elements on a light receiving region, and outputs an image signal corresponding to an image of the original document D is output by line-scanning the light receiving region and repeating of the line-scanning.

The image signal output from the CCD 10 is amplified by a signal processing unit 93 and is converted into a digital signal. After the digital signal is suitably processed by an image processing unit 55, the signal is supplied to a laser unit 27. The laser unit 27 emits a laser beam B according to an input signal.

A window 12 for reading the original document is provided on a position in which the original document stand 2 is adjacent to the indicator 3. The window 12 has a shape and dimension corresponding to a length of a longitudinal direction of the indicator 3.

An automatic original document feeding device (ADF) 40 which functions as an original document stand cover for which opening and closing is possible is provided on the original document stand 2, the indicator 3, and the window 12. The automatic original document feeding device 40 includes a tray for placing original documents 41, and transports a plurality of the original documents D set in the tray 41 to the window 12 one by one, such that the document passes over the window 12 and the passed original document D is discharged to a tray 42.

When the automatic original document feeding device 40 is operated, the exposure lamp 5 emits at a position corresponding to the window 12, and the light is applied to the window 12. The light applied to the window 12 is used to expose the original document D which passes over the window 12 through the window 12.

By such an exposure, a reflection light image of the original document D is obtained and is projected to the CCD 10 by reflection mirrors 6, 7, and 8 and the magnification lens block 9.

On the upper surface portion of the main body 1, a position in which the automatic original document feeding device 40 does not overlap, the control panel 13 is provided as an operation unit for setting an operation condition. As illustrated in FIG. 2, the control panel 13 includes a touch panel type liquid crystal display unit 14, ten keys 15 for inputting numerical values, an all clear key 16, a copy key 17, and a stop key 18. The control panel 13 functions as the operation unit for setting a maintenance mode.

The liquid crystal display unit 14 can be used to input information by a touch operation of fingers and display various information including the input information. By touching the liquid crystal display unit 14 with fingers, it is possible to set a type or a condition of an image forming, designate a size of a sheet P to be described later, or input various codes for maintenance.

Meanwhile, a photoconductive drum 20 which is an image carrier is rotatably provided in a substantial central portion inside of the main body 1. In a periphery of the photoconductive drum 20, a main charger unit 21, a developing unit 22, a transfer belt unit 23, a cleaner 24, and a destaticizing unit 25 are sequentially arranged. The laser beam B emitted from the above described the laser unit 27 is applied to a surface of the photoconductive drum 20 by passing through a space between the main charger unit 21 and the developing unit 22. Therefore, an electrostatic latent image is formed on the surface of the photoconductive drum.

In a color image forming apparatus, units thereof are provided in parallel in each color toner, for example, yellow (Y), magenta (M), cyan (C), and black (K). Each component which received light by the CCD 10 is spectrally refracted, and the resultant is respectively developed in each unit thereof. The developed image of each toner is overlapped on the transfer belt to be described later, and a color visible image is obtained. Here, a common structure will be described without dividing each color.

A cleaner and drum unit is configured to have the photoconductive drum 20 and the cleaner 24. In the cleaner and drum unit, each of the photoconductive drum 20 and a main blade, a fur blush, and an ozone filter in the cleaner 24 is a sub unit.

The main charger unit 21 includes a grid, a wire, a wire cleaning pad, and the like. The developing unit 22 includes a developer (toner), a toner filter, a toner bag, and the like.

The transfer belt unit 23 includes a transfer belt 23*a*, a transfer belt blade 23*b*, a transfer belt blush 23*c*, and the like.

Moreover, in FIG. 3, it is drawn that one toner image is transferred to the transfer belt 23*a* from one photoconductive drum 20. However, in the color image forming apparatus, as described above, for example, four toner images corresponding to each color toner are transferred to the transfer belt 23*a* from each photoconductive drum so as to overlap. Accordingly, in a case of the color image forming apparatus, the transfer belt 23*a* is longer.

A plurality of sheet cassettes 30 is provided on a bottom portion in the main body 1. In such a sheet cassette 30, a number of sheets P having different sizes from each other are accommodated. When pressing the copy key 17, recording media (sheet P) are taken out one by one from any one of the sheet cassettes 30. As a member for taking out the recording media, each pick-up (P/U) roller 31 is provided.

The taken out sheets P are respectively separated from the sheet cassette 30 by the separation roller 32 and are fed to a resist roller 34 by a feeding roller 33. At timing in consideration of a rotation of the photoconductive drum 20, the resist roller 34 feeds the sheet P between the photoconductive drum 20 and the transfer belt unit 23.

A manual feed tray 35 is detachably provided on a side portion of the main body 1. After the sheet P set in the manual feed tray 35 is taken out by a pick-up (P/U) roller 36 and is fed to the resist roller 34 by a feeding roller 36*a*.

By applying bias voltage at a high level to the photoconductive drum 20, the main charger unit 21 electrostatic-charges a surface of the photoconductive drum 20. The laser beam B emitted from the laser unit 27 is applied to the surface of the photoconductive drum 20 in which charging is finished. The laser unit 27 forms the electrostatic latent image corresponding to a reading image from the original document D on the surface of the photoconductive drum 20 by main-scanning (line-scanning) the surface of the photoconductive drum 20 in one direction and sub-scanning of repeating the main-scanning along the rotation of the photoconductive drum 20.

The electrostatic latent image on the photoconductive drum 20 is developed and becomes a visible image by receiving the toner from the developing unit 22. The visible image is transferred to the sheet P by the transfer belt unit 23. The sheet P on which the image is printed is separated from the photoconductive drum 20 and is fed to a fixing unit 37. The developer and charge are remained on the surface of the photoconductive drum 20 from which the sheet P is separated. The remained developer is removed by the cleaner 24. The remained charge is removed by the destaticizing unit 25.

The fixing unit 37 includes a heat roller 37*a*, a press roller 37*b*, a cleaning web (WEB) 37*c*, a web roller 37*d*, an oil roller 37*c*, an aluminum roller 37*e*, and the like. The image transferred on the sheet P is fixed by being heated and pressed by the fixing unit 37. The sheet P in which the fixing is finished is discharged to a tray 39 of the outside of the main body 1 by a paper discharge roller 38.

The automatic original document feeding device 40 includes the pick-up (P/U) roller, the feeding roller, the separation roller, and the like, as a sub unit.

Moreover, there is also a main unit in which each P/U roller 31 and 36, each separation roller 32, each feeding roller 33 and 36*a*, and the like, are included as a sub unit, and the main unit is called a feeding roller unit.

Figure 4:
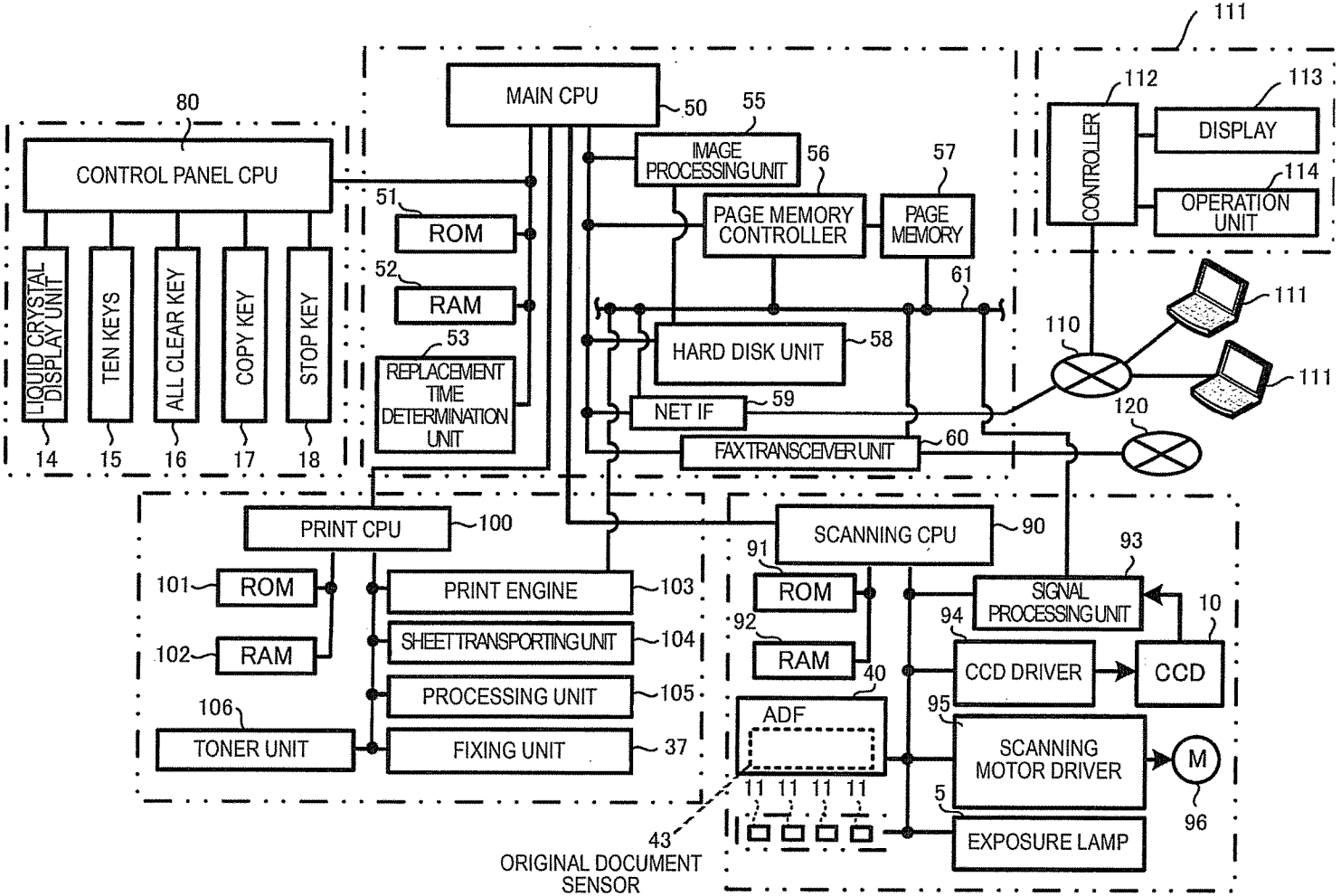
FIG. 4 is a block diagram illustrating an electrical block configuration.

FIG. 4 is a diagram illustrated a schematic configuration of a control circuit of the image forming apparatus. A main CPU 50 is connected to a control panel CPU 80, a scanning CPU 90, and a print CPU 100. The main CPU 50 overall controls the control panel CPU 80, the scanning CPU 90, and the print CPU 100, and includes a control unit in a copy mode corresponding to an operation of the copy key 17, a control unit in a print mode corresponding to inputting an image to a net interface 59 to be described later, and a control unit in a facsimile mode (FAX) corresponding to receiving the image by a FAX transceiver unit 60 to be described later.

In addition, a ROM 51 for storing a control program, a RAM 52 for storing data, a replacement time determination unit 53 to be described later, the image processing unit 55, a page memory controller 56, a hard disk unit 58, the net interface 59, and the FAX transceiver unit 60 are connected to the main CPU 50. The page memory controller 56 controls writing and reading of image data in response to a page memory 57. In addition, the image processing unit 55, the page memory controller 56, the page memory 57, the hard disk unit 58, the net interface 59, and the FAX transceiver unit 60 are connected to each other through an image data bus 61.

The net interface 59 functions as an input unit for a printer mode in which the image (image data) transferred from an external device is input. A communication network 110 such as LAN or Internet is connected to the net interface 59, and the external devices, for example, multiple personal computers 111 are connected to the communication network 110. The personal computer 111 includes a controller 112, a display 113, and an operation unit 114.

The FAX transceiver unit 60 is connected to a telephone wire 120, and functions as a receiving unit for the facsimile mode in which the facsimile transmission image (image data) is received through the telephone wire 120.

The liquid crystal display unit 14, the ten keys 15, the all clear key 16, the copy key 17, and the stop key 18 are connected to the control panel CPU 80.

A ROM 91 for storing the control program, a RAM 92 for storing the data, the signal processing unit 93 that processes outputting of the CCD 10 and supplies the resultant to the image data bus 61, a CCD driver 94, a scanning motor driver 95, an exposure lamp 5, an automatic original document feeding device (ADF) 40, the plurality of original document sensors 11, and the like are connected to the scanning CPU 90.

The CCD driver 94 drives the CCD 10. The scanning motor driver 95 drives a scanning motor 96 for driving the carriage. The automatic original document feeding device 40 includes the original document D set in the tray 41 and an original document sensor 43 for detecting the size of the original document. A reading unit in a copy mode is mainly configured to have the scanning CPU 90 and the peripheries thereof, and optically reads the image of the original document D.

A ROM 101 for storing a control program, a RAM 102 for storing data, a print engine 103, a sheet transporting unit 104, a processing unit 105, a toner unit 106, and the fixing unit 37 are connected to the print CPU 100. The print engine 103 is configured to have the laser unit 27, driving circuits thereof, and the like. The sheet transporting unit 104 is configured to have a sheet transporting passage from the sheet cassette 30 to the tray 39 and the feeding roller units, driving circuits thereof, and the like.

The processing unit 105 is configured to have the cleaner and drum unit, the main charger unit 21, the developing unit 22, the transfer belt unit 23, and the like. In addition, the toner unit 106 is configured to have toner cartridges which accommodate each color toner. The fixing unit 37 is configured to have fixing mechanisms 35, driving circuits thereof, and the like.

The image forming unit is configured to mainly have the print CPU 100 and peripheries thereof, and prints the image processed by the image processing unit 55 on the sheet P of the sheet cassette 30. The image forming unit includes both of the developing unit which develops the electrostatic latent image on the photoconductive drum and the fixing unit which fixes the image on the sheet P.

The main CPU 50 includes, as a main function, the control unit of the copy mode, the control unit of the print mode, and the control unit of the FAX mode, and in addition, includes a control unit which displays information relating to a consumption of each main unit on the liquid crystal display unit 14 when a maintenance mode is set by the control panel 13. A description thereof will be made later.

<A Case in which a Replacement Target Component is a Photoconductive Drum>

When the toner is a metallic toner, or the like, compared to a color toner for general use, a life span of each component in which the toner is attached is influenced. The component of which the life span is specifically influenced by a use of the metallic toner is a photoreceptor or a fixing belt. Here, as a replacement target component, an example of a case of the photoconductive drum will be described.

Figure 5:
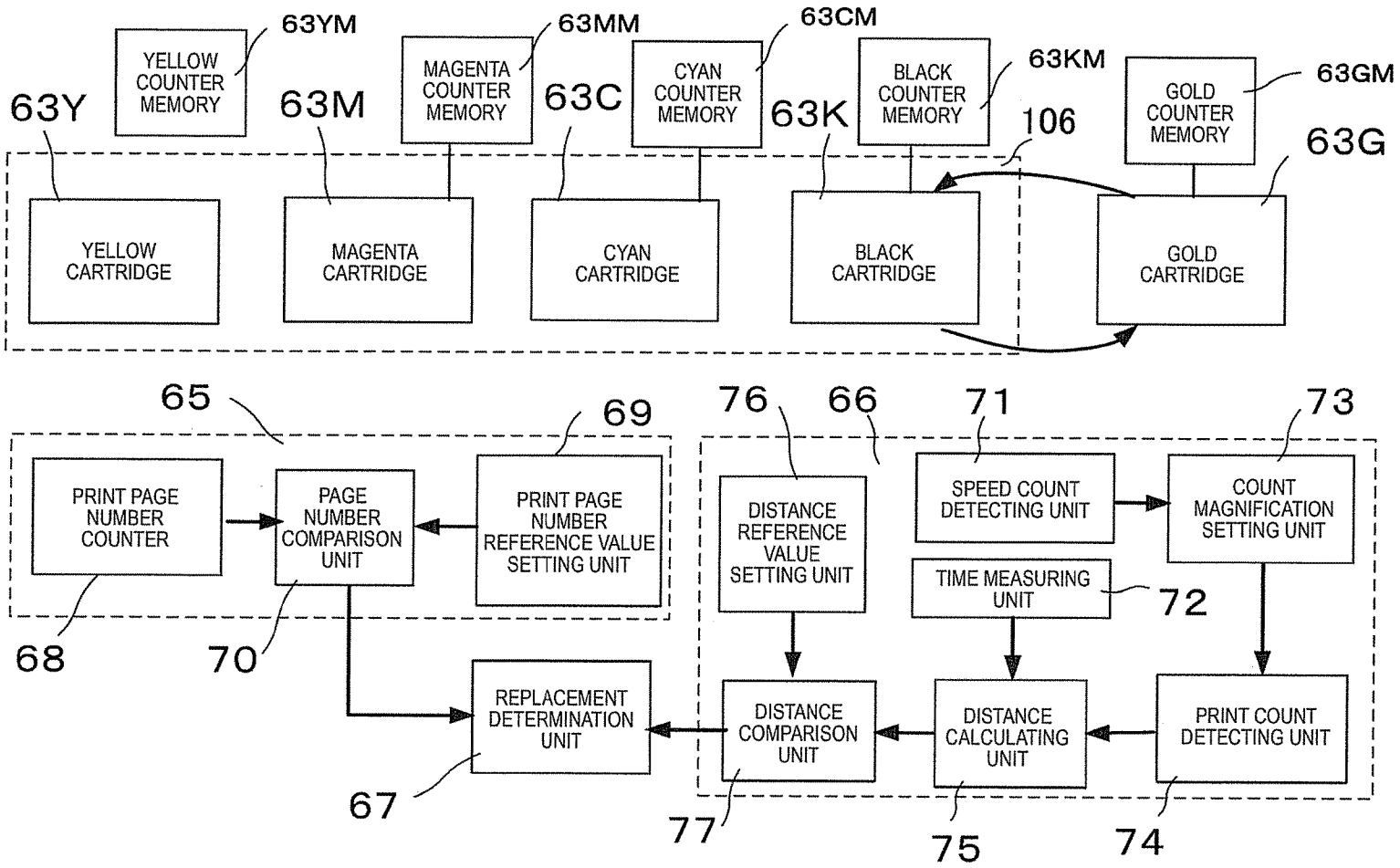
FIG. 5 is a block diagram illustrating a configuration example of a replacement time determination unit, and the like in FIG. 4.

FIG. 5 is a diagram illustrating a functional configuration example of the replacement time determination unit 53 and a configuration of the toner unit. Actually, each unit is configured to use the RAM 52, the ROM 51, and the like under control of the main CPU 50.

The toner unit 106 in color image forming apparatus is generally configured to use a yellow cartridge 63Y, a magenta cartridge 63M, a cyan cartridge 63C, and a black cartridge 63K which respectively correspond to each color. In addition, when a gold cartridge 63G which accommodates the decorative toner, for example, a gold color metallic toner is required, for example, the gold cartridge 63G is substituted instead of the black cartridge 63K. Here, with respect to the decorative toner such as the metallic toner, a toner for a general use (pigment toner) is referred to as a color toner.

A yellow counter memory 63YM, a magenta counter memory 63MM, a cyan counter memory 63CM, a black counter memory 63KM, and a gold counter memory 63GM corresponding to each cartridge, which temporally store a value of a calculating the number of pages, or the like, are provided. The counter value of the counter memory is stored in the RAM 102.

When the black cartridge 63K is in the toner unit 106, the counter value of the black toner so far is temporally stored in the black counter memory 63KM corresponding thereto. When the gold cartridge 63G is inserted into the toner unit 106 instead of the black cartridge 63K, counting of the gold toner is started. When the black cartridge 63K is inserted into the toner unit 106 instead of the gold cartridge 63G, the counter value of the gold cartridge 63G is temporally stored in the gold counter memory 63GM. Meanwhile, the counter value of the black counter memory 63KM is read by the RAM 102, and then the counting is restarted.

The metallic toner is a toner including mica in a toner resin. The mica dispersed in the toner is approximately 3 μm to 30 μm in a length, and functions as a pigment because of a characteristic of shinning. The metallic toner which is printed on the recording medium is shown as a gold color. Since the mica is firm and has a distorted shape, when developing is repeatedly performed on a surface of the photoreceptor, the surface of the photoreceptor is damaged, and the damage proceeds with increasing speed more than in a case of only using other color toner for general use. When observing a surface of the photoreceptor, it is recognized that many fine scratches are generated on the surface thereof. Accordingly, the life span of the photoreceptor is shorter than in a general case.

The replacement time determination unit 53 includes a page number condition unit 65 which detects the replacement time (life span) based on the number of pages of the printed sheets P, a distance condition unit 66 which detects the replacement time corresponding to a used distance (speed×time), and a replacement determination unit 67 which determines the replacement time in response to a result from the page number condition unit 65 and the distance condition unit 66.

The page number condition unit 65 includes a print page number counter 68 which counts the number of pages which are actually printed, and a page number reference value setting unit 69 which presets the print page number as the replacement time. The page number condition unit 65 further includes a page number comparison unit 70 which compares the actually measured print page number of the print page number counter 68 with a reference value page number set by the print page number reference value setting unit 69. A default value can be preset so that the page number value set by the print page number reference value setting unit 69 does not need to be input.

Moreover, here, a reason of using the page number instead of a sheet number is that the page number is two even one sheet is used when performing a double-sided printing, and therefore, a manner using the page number for the life span is more accurate.

The distance condition unit 66 includes a speed count detecting unit 71 which counts a speed at a time of printing, a time measuring unit 72 which measures the time at the speed, and a count magnification setting unit 73 which sets a magnification corresponding to a toner type in response to the count value of an output of the speed count detecting unit 71.

The distance condition unit 66 further includes a print count detecting unit 74 which detects a count value which is multiplied by the magnification in the count magnification setting unit 73, a distance calculating unit 75 which calculates a distance obtained by multiplying the count value which is multiplied by the magnification at each speed by each time, a distance reference value setting unit 76 which presets a distance of the replacement time, and a distance comparison unit 77 which compares a distance calculated by the distance calculating unit 75 with a distance reference value preset by the distance reference value setting unit 76. As a reference value set by the distance reference value setting unit 76, the default value can be determined in advance so as not to need to be input.

In addition, the distance is calculated by multiplying the count value of the speed by the count magnification (speed count magnification) and then multiplying the resultant by the time. However, the distance may be calculated by multiplying the count value of the time by the count magnification (time count magnification), and then multiplying the resultant by the speed. In any case, a print distance is calculated by multiplying the count value proportional to the speed by the count value proportional to the print time, and further multiplying the resultant by the count magnification corresponding to the decorative toner. Here, the count magnification setting unit changes the count method.

A configuration of each part in FIG. 5 is shown as a functional block. In many cases, an actual specific measurement, detection, input, calculation, and the like are performed by other parts.

Figure 6:
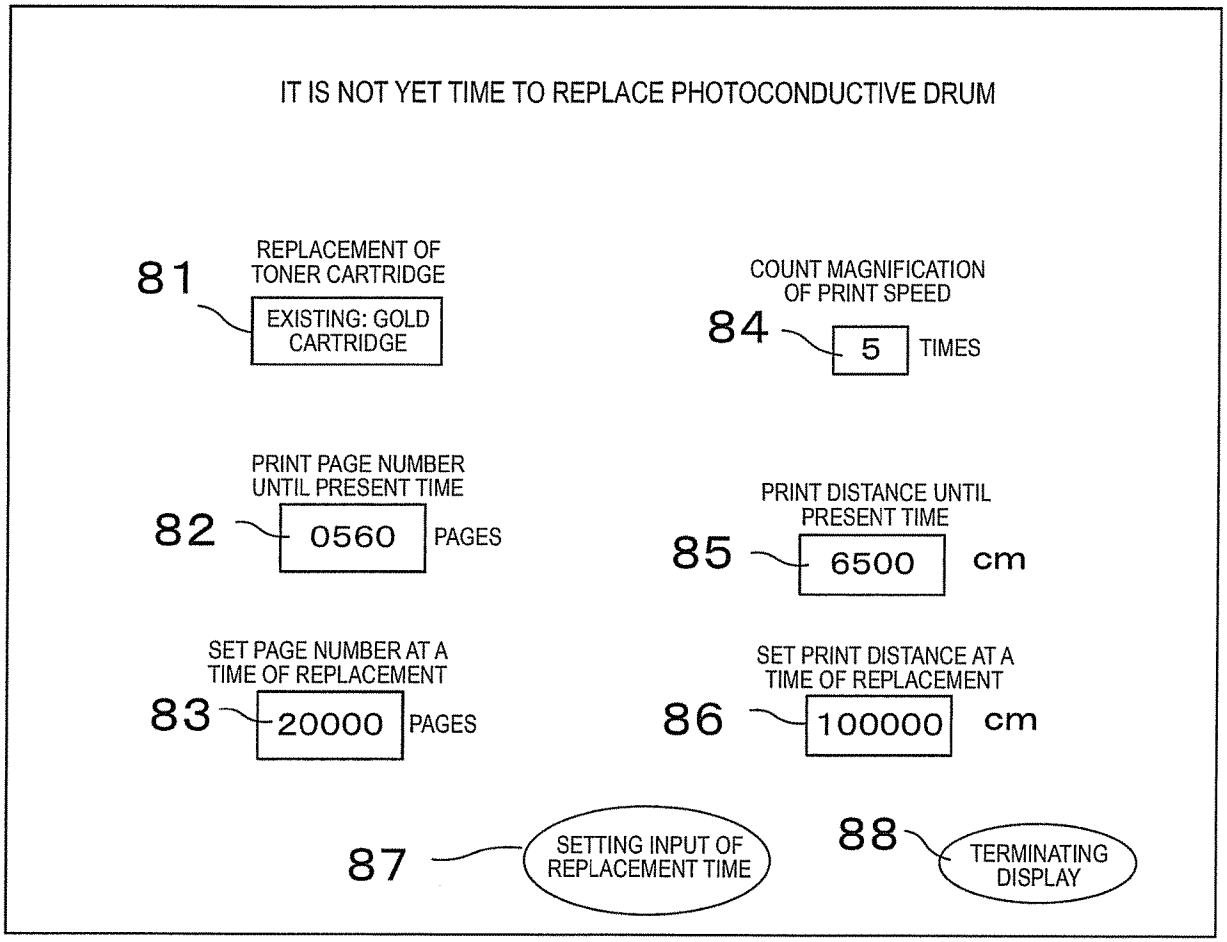
FIG. 6 is a view illustrating a display example of a liquid crystal display unit of the control panel.

An example of a screen displaying the liquid crystal display unit 14 of the control panel 13 in a maintenance mode is illustrated in FIG. 6. First, a box 81 at a left upper side in the screen displays a notification indicating whether or not the toner cartridge is replaced. In the embodiment, the black cartridge can be replaced. In this display example, it is illustrated that the toner cartridge is replaced with the gold cartridge.

Next, in a box 82 below the box 81, the print page number until the present time after the replacement of the photoconductive drum is displayed. The print page number counter 68 of the page number condition unit 65 detects the print page number of the sheets P printed under control of the print CPU 100. In addition, in a box 83 below the box 82, the page number reference value until a replacement time of the photoconductive drum is displayed.

In a box 84 at a right upper side of the liquid crystal display unit 14 of the control panel 13, the count magnification of the speed is displayed. A speed count magnification is a magnification multiplied by the count number which is proportional to the speed. When a toner being used is metallic toner, or the like, which greatly damages the surface of the photoconductive drum, the magnification is set to be high and an equivalent print speed is fast.

The count magnification is automatically set by the replaced cartridge. In a case of the metallic toner, for example, the count magnification becomes 5. Of course, for example, the count magnification may be capable of being input using the ten keys 15 corresponding to an arbitrary replaced toner on the screen of the liquid crystal display unit 14 in FIG. 6. However, it is preferable that the count magnification of the speed is generally 10 or less. Generally, when a plurality of toners is used, the count magnification corresponding to the toner which has the most influence with respect to the life span of the photoconductive drum, or the like is used and the calculation is performed.

In a box 85 below the box 84, the print distance until the present time is displayed. The print distance is a value obtained by multiplying the print speed by the print time. The print speed is controlled by the print CPU 100 so as to be detected. The print speed is a value obtained by multiplying the actual print speed by the count magnification corresponding to the toner.

In a box 86 below the box 85, the print distance set as the replacement time is displayed. Further, in the lowermost end, a replacement time setting input icon 87 and a display terminating icon 88 are displayed. When the display terminating icon is clicked, the screen at the time of the maintenance mode is closed. When the replacement time setting input icon 87 is clicked, the page number of the replacement time of the photoconductive drum and the print distance of the replacement time can be set on the box 83 and the box 86 using the ten keys 15, or the like. In an example of FIG. 6, a set page number at the time of the replacement is set to 20000 pages, and the set print distance at the time of the replacement is set to 100000 cm.

The set print page number reference value is stored in the print page number reference value setting unit 69 by being input to the box 83. Meanwhile, the print distance reference value set by inputting into the box 86 is stored in the distance reference value setting unit 76.

The print page number until the present time displayed on the box 82 and the set page number at the time of the replacement displayed on the box 83 are temporally stored in the RAM 52, and are compared under control of the main CPU 50. In the same manner, the print distance until the present time displayed on the box 85 and the set print distance at the replacement time displayed on the box 86 are temporally stored in the RAM 52, and are compared under control of the main CPU 50.

At the time of the maintenance mode, in a case in which the print page number until the present time displayed on the box 82 does not reach the set page number at the time of the replacement displayed on the box 83, and the print distance until the present time displayed on the box 85 does not reach the set print distance at the time of the replacement displayed on the box 86, for example, "It is not yet time to replace the photoconductive drum" is displayed as described in the uppermost end of FIG. 6. When both the print page number and the print distance respectively coincide with the set values, the maintenance mode is automatically executed, and "It is time to replace the photoconductive drum." is displayed on the liquid crystal display unit 14.

Next, an operation of entirety of the image forming apparatus will be schematically described. When the original document D is set in the original document stand 2, a set state thereof is detected by each original document sensor 11 and the size of the set original document D is detected by the original document sensor 11. In addition, when the copy key 17 is turned on, an image of the original document D on the original document stand 2 is read, the read image (image data) is stored in the page memory 57.

When the image (image data) transmitted from the personal computer 111 through the communication network 110 is input to the net interface 59, the input image (image data) is stored in the page memory 57.

When the facsimile transmission image (image data) through the telephone wire 120 is received by the FAX transceiver unit 60, the image (image data) is stored in the page memory 57.

The image stored in the page memory 57 is image-processed by the image processing unit 55. While the laser unit 27 according to the processed image is turned on and off, an upper side of the photoconductive drum 20 is main-scanned or sub-scanned by the laser beam B emitted from the laser unit 27. Accordingly, the electrostatic latent image is formed according to the image on the photoconductive drum 20.

The electrostatic latent image formed on the photoconductive drum 20 is developed and becomes a visible image by receiving the toner from the developing unit 22. The visible image is transferred to the sheet P by the transfer belt unit 23. The sheet P on which the image is printed is separated from the photoconductive drum 20 and is fed to the fixing unit 37. The sheet P in which fixing is finished by the fixing unit 37 is discharged to the tray 39 outside the main body 1.

A service man who regularly visits to clean the apparatus sets the maintenance mode by inputting a predetermined code using the ten keys 15 of the control panel 13.

When the maintenance mode is set, the liquid crystal display unit 14 of the control panel 13 displays information relating a consumption (replacement time) of each main unit (the cleaner and drum unit, the main charger unit 21, the developing unit 22, a toner collecting box, the transfer belt unit 23, the fixing unit 37, the automatic original document feeding device 40, the feeding roller unit, and the like). An example thereof is a display the information relating to the replacement time of the photoconductive drum 20.

Figure 7:
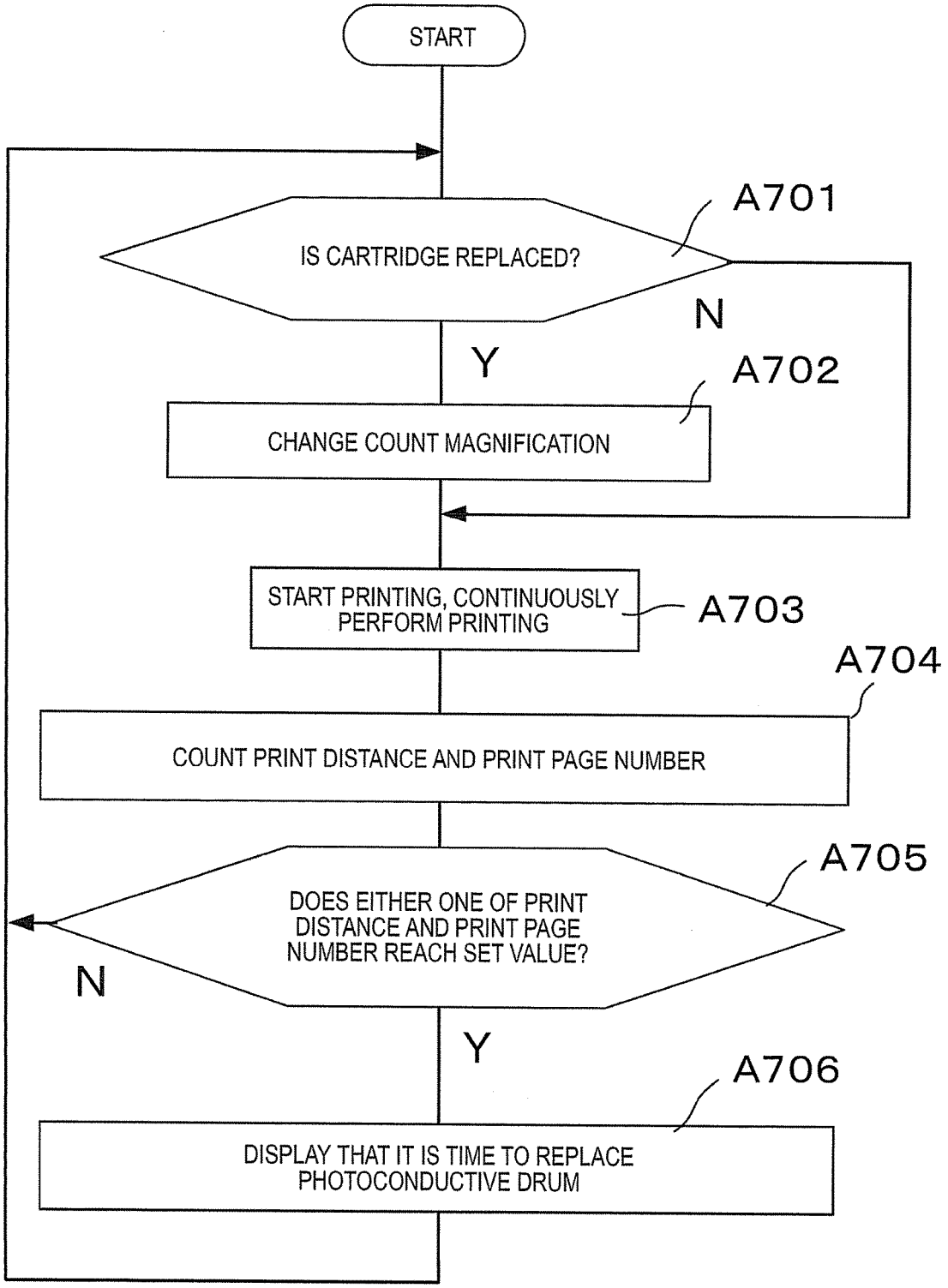
FIG. 7 is a flow chart for describing an operation.

Next, in the image forming apparatus, an operation of the replacement time of the photoconductive drum 20 in a case of replacing a cartridge which is apart of the toner unit 106, for example, the black cartridge with the gold cartridge is described in FIG. 7 using a flow chart.

When starting, it is detected whether or not the cartridge of the toner unit 106 is replaced in ACT A701. The replacement described above is detected by the print CPU 100. For example, when the black cartridge is replaced with the gold cartridge, the print CPU 100 causes the counter value of the black cartridge 63K to be stored in the black counter memory 63KM provided in the RAM 102.

In ACT A702, a count magnification thereof is automatically changed to the count magnification at a speed corresponding to the metallic toner of the gold cartridge 63G by the count magnification setting unit 73 illustrated in FIG. 5. The change of the count magnification, for example, may be performed by being manually input using the ten keys 15 of the control panel 13 illustrated in FIG. 2. The count magnification, for example, is experientially calculated in advance according to the components of the toner, and is stored in the RAM 102. In this case, the count magnification setting unit 73 becomes a count changing unit.

In the next ACT A703, the main CPU starts and continuously performs printing by the image forming apparatus based on an instruction input by an operator using the control panel 13. In a case in which the cartridge is not replaced in ACT A701 (N in A701), ACT A702 is skipped, and printing is continuously performed in ACT A703.

In ACT A704, as described above, the print page number is counted by the print page number counter 68 of the page number condition unit 65 illustrated in FIG. 5. Meanwhile, the distance calculating unit 75 of the distance condition unit 66 calculates the print distance.

In the next ACT A705, it is determined whether or not either one of the print distance and the print page number reaches a set value. A determination is made by the replacement determination unit 67 on the basis of whether an output is made indicating that the print page number set by the page number comparison unit 70 of the page number condition unit 65 illustrated in FIG. 5 is reached, or whether an output is made indicating that the distance set by the distance comparison unit 77 of the distance condition unit 66 is reached.

When a control signal of either one reaching the set value is input to the replacement determination unit 67, ACT A705 is YES. "It is time to replace the photoconductive drum 20" is displayed on the liquid crystal display unit 14 of the control panel 13, and the operator is asked to perform the replacement. When the photoconductive drum 20 is replaced, a procedure returns ACT A701, and it is detected that the cartridge is replaced. Meanwhile, when both of the print page number and the print distance do not reach a predetermined set value (N in A705), the procedure returns to ACT A701.

When it is detected that the gold cartridge 63G is replaced with the black cartridge 63K in ACT A701, the count magnification returns to 1 in ACT A702. Moreover, in the RAM 102 controlled by the print CPU 100, the count value of the gold cartridge 63G is stored, the count value of the black cartridge 63K is read, and the counting starts.

Hereinafter, in the same manner, printing is continuously performed, and whether or not the print distance and the print page number reach the predetermined set value is determined by the replacement determination unit 67.

The embodiment describes a case in which an object of which the replacement time is detected is the photoconductive drum. However, a component of which the replacement time is detected according to the an exemplary embodiment is not limited to a photoreceptor. A component of which the life span is influenced by a use of the decorative toner such as the metallic toner is a photoconductive drum or a cleaner unit such as a cleaning blade, a transfer unit including a transfer belt, a fixing unit including a secondary transfer roller, a fixing belt, a heat roller, and a press roller, or the like. When determining a life span of these components (replacement time), exemplary embodiments can be applied.

In addition, in above described embodiment, a case of the metallic toner of the gold toner is described as a toner of the cartridge to be replaced. However, the exemplary embodiment is not limited to the metallic toner, and can be applied to a replacement when using a toner affect on a length of the life span thereof. Here, a toner influencing a length (replacement time) of the life span thereof is referred to as the decorative toner.

In the embodiment, for the sake of easy understanding, the replacement time determination unit 53 is illustrated as illustrated in FIG. 4 for functional description. However, without separately providing the replacement time determination unit as illustrated in FIG. 4, a process of the exemplary embodiment may be performed by each CPU and a storage unit such as the RAM, and the ROM illustrated in FIG. 4.

In the above described embodiment, the print distance is compared to the distance reference value, and the print page number is compared to the print page number reference value. A display of replacement is displayed on the liquid crystal display unit 14 of the control panel 13 when either one of the values reaches the reference value. However, the replacement of the component may be notified when the print distance reaches the distance reference value by only comparing the print distance with the distance reference value.

In addition, in the above described embodiment, when it is time to perform the replacement, the operator is alerted by the information displayed on the liquid crystal display unit of the control panel. However, the operator may be alert by a manner such as generating sound, informing by mailing, or the like without displaying or with displaying the information.

According to the embodiment, even when the decorative toner such as the metallic toner is used, an image forming apparatus can be obtained in which the replacement time of individual units such as the photoconductive drum can be objectively known regardless of an experience of the service man.

While certain embodiments have been described these embodiments have been presented by way of example only, and are not intended to limit the scope of the inventions. Indeed, the novel apparatus and methods described herein may be embodied in a variety of other forms: furthermore various omissions, substitutions and changes in the form of the apparatus and methods described herein may be made without departing from the spirit of the inventions. The accompanying claims and there equivalents are intended to cover such forms of modifications as would fall within the scope and spirit of the invention.

What is claimed is:

1. An image forming apparatus comprising:

a first toner providing unit configured to provide a first toner that is at least one color toner selected a yellow toner, a magenta toner, a cyan toner and a black toner;

a second toner providing unit configured to provide a second toner having decorative characteristics;

a count unit configured to count a use amount of a consumption component or an apparatus which are used in the image forming apparatus; and a count changing unit configured to change a count method of the count unit depend on whether the first toner is used or both of the first toner and the second toner are used in order to form an image.

2. The apparatus to claim 1, wherein the use amount in the count unit is calculated based on a print distance by multiplying a count value of a print speed by a time count value of a print time.

3. The apparatus according to claim 1, wherein if both of the first toner and the second toner are used in order to form the image, the count changing unit sets a magnification of the count in the count unit higher than in a case the first toner is used.

4. The apparatus according to claim 1, wherein the second toner is a metallic toner.

5. The apparatus to claim 1, further comprising an image forming unit configured to form a toner image by developing an electrostatic latent image on an image carrier using the first toner or the second toner and perform printing by fixing the toner image on a recording medium; and a replacement time informing unit configured to inform that it is time to replace the image carrier.

6. The apparatus to claim 5, further comprising a count magnification setting unit configured to set a count magnification depend on whether or not the second toner is used for forming the toner image, the replacement component being used for printing in the image forming apparatus; and a distance calculating unit configured to calculate a print distance by multiplying the count magnification set by the count magnification setting unit by the speed count value and the time count value which are obtained by the count unit, wherein the replacement time informing unit informs the replacement time if detecting that the print distance reaches a preset distance reference value calculated by the distance calculating unit to a preset distance reference value.

7. An image forming method comprising:

forming a toner image by developing an electrostatic latent image formed on an image carrier using a first toner that is at least one color toner selected a yellow toner, a magenta toner, a cyan toner and a black toner, and a second toner having decorative characteristics;

counting a use amount of a consumption component or an apparatus used for forming the toner image according to an image forming condition; and determining the toner used for forming the toner image, and changing a count method of the use amount set according to the image forming condition in response to the determined result.

8. The method according to claim 7, wherein the image forming condition is whether or not the second toner is used, and wherein if the second toner is used to form the toner image, a magnification of the count is set higher than in a case of a the first toner only.

9. The method according to claim 8, wherein the count method of the use amount calculates the print distance by multiplying a count value of a print speed by a time count value of a print time.

* * * * *